US011478393B2

(12) United States Patent
Grbic

(10) Patent No.: US 11,478,393 B2
(45) Date of Patent: Oct. 25, 2022

(54) DEVICE FOR VIBRATION TRAINING

(71) Applicant: Svetozar Grbic, Munich (DE)

(72) Inventor: Svetozar Grbic, Munich (DE)

( * ) Notice: Subject to any disclaimer, the term of this patent is extended or adjusted under 35 U.S.C. 154(b) by 870 days.

(21) Appl. No.: 16/334,261

(22) PCT Filed: Sep. 19, 2017

(86) PCT No.: PCT/EP2017/073654
§ 371 (c)(1),
(2) Date: Apr. 8, 2019

(87) PCT Pub. No.: WO2018/054908
PCT Pub. Date: Mar. 29, 2018

(65) Prior Publication Data

US 2019/0262209 A1 Aug. 29, 2019

(30) Foreign Application Priority Data

Sep. 20, 2016 (DE) ..... 202016105235.1

(51) Int. Cl.
*A61H 1/00* (2006.01)
*A63B 21/00* (2006.01)
*A61H 23/02* (2006.01)

(52) U.S. Cl.
CPC ..... *A61H 1/005* (2013.01); *A61H 23/0254* (2013.01); *A63B 21/00178* (2013.01); *A63B 21/4033* (2015.10); *A61H 2201/123* (2013.01); *A61H 2201/1215* (2013.01); *A61H 2201/149* (2013.01); *A61H 2201/1666* (2013.01); *A61H 2201/1676* (2013.01); *A61H 2201/501* (2013.01); *A61H 2201/5005* (2013.01); *A63B 2208/0209* (2013.01)

(58) Field of Classification Search
CPC ..... A61H 1/005; A61H 23/0254; A61H 2201/1215; A61H 2201/123; A61H 2201/149; A61H 2201/1666; A61H 2201/1676; A61H 2201/5005; A61H 2201/501; A63B 21/00178; A63B 21/4033; A63B 2208/0209
See application file for complete search history.

(56) References Cited

U.S. PATENT DOCUMENTS 4,061,137 A * 12/1977 Sandt ..... A61G 13/009 5/915
7,854,709 B2 * 12/2010 Neff ..... A61H 23/0263 601/51
2017/0014301 A1 * 1/2017 Lin ..... A61H 23/0254
2020/0097088 A1 * 3/2020 Welch ..... A63F 13/28

FOREIGN PATENT DOCUMENTS

| | | | |
|---|---|---|---|
| CN | 201182721 | Y | 1/2009 |
| CN | 104941111 | A | 9/2015 |
| CN | 105167984 | A | 12/2015 |
| DE | 19944456 | A1 | 3/2001 |
| DE | 202007008887 | U1 | 11/2007 |
| DE | 102010052494 | A1 | 9/2012 |
| DE | 202012007856 | U1 | 10/2012 |
| DE | 102013013180 | B4 | 10/2017 |
| WO | 2013022382 | A2 | 2/2013 |

* cited by examiner

*Primary Examiner* — Garrett K Atkinson
(74) *Attorney, Agent, or Firm* — Dykema Gossett PLLC

(57) ABSTRACT

The invention relates to a device for vibration training, comprising a platform, a first actuator configured to make said platform move vibrationally, and a second actuator configured to make said platform move in a rocking manner.

13 Claims, 3 Drawing Sheets

DEVICE FOR VIBRATION TRAINING

CROSS-REFERENCE TO RELATED APPLICATIONS

This application is a national stage filing based upon International PCT Application No. PCT/EP2017/073654, filed 9 Sep. 2017, which claims the benefit of priority to Germany application No. 202016105235.1, filed 20 Sep. 2016.

BACKGROUND

The invention relates to a device for vibration training, comprising a platform, a first actuator, which is configured to set the platform in a vibration movement, and a second actuator, which is configured to set the platform in a rocking movement.

Devices for vibration training are used, for example, in fitness sport, in rehabilitation or in physiotherapy for strengthening the muscles and for improving balance and coordination.

In devices of the type in question, vibration movements of a platform are transmitted to a device user, and the vibrations trigger muscle reflexes. The muscle reflexes result in muscle contractions. These muscle stresses ultimately lead to targeted and intensive training.

In addition to conventional devices for vibration training that comprise a platform that can be set in a vibration movement, more far-reaching solutions are also known from the prior art.

EP 1 541 112 A1 proposes a muscle stimulation and massage device having a foot plate, a column and a vibration unit. The column stands on the foot plate and comprises two guide rail turrets spaced laterally apart from each other, each of them having at least one guide rail. A lift can be driven up and down on the guide rails, such that it can be driven to different heights in relation to the foot plate and can be locked at these heights. The lift has the form of U-shaped support framework. A vibration unit is secured between the open ends of the support framework.

Moreover, DE 20 2012 007 856 U1 discloses a rocker with a stand plate, wherein the stand plate can be moved in a rocking movement, two measurement sensors are integrated on the stand plate, the stability of the stand plate can be adjusted via rubber rings or springs, and a vibration system operating according to the imbalance or eccentric principle is secured on the stand plate and, depending on the angle of tilt, can be actuated via the on/off function or by means of a change of intensity.

However, in these and other known solutions, the platform is limited in terms of its variety of movement. The limited number of types of movement also means that only certain groups of muscles can be trained. Moreover, the training results that can be achieved in terms of improved balance and coordination are considerably limited by the restricted number of types of movement.

SUMMARY OF THE INVENTION

The object of the invention is therefore to make available a device for vibration training which, compared to the known devices, permits more effective, more varied and/or more intensive training.

The object is achieved with a device for vibration training of the type mentioned at the outset, wherein the device according to the invention has a third actuator, which is configured to set the platform in a linear movement.

The invention exploits the finding that, in addition to the vibration movement and the rocking movement of the platform, a linear movement of the platform can also be used to cause muscle reflexes. The muscle reflexes caused by the linear movement of the platform differ here from the muscle reflexes caused by the vibration movement and the rocking movement of the platform, and this results in modified stressing of the muscles. The training can thus be made more effective, more varied and/or more intensive.

In a particularly preferred embodiment of the device according to the invention, the third actuator is configured to move the platform to and fro. The linear movement of the platform thus comprises a movement of the platform along a linear movement path in a first direction and a movement of the platform along the movement path in a second direction, wherein the first direction and the second direction are oriented counter to each other. By means of the changes of direction, the stressed groups of muscles are extended and the training-induced improvement in the balance and coordination of the device user is further promoted.

In an advantageous embodiment of the device according to the invention, the third actuator is configured to move the platform within an at least substantially horizontal plane. The linear movement of the platform, provided by the third actuator, can thus provide a substantially horizontal oscillating movement of the platform. For example, the third actuator causes the platform to move alternately back and forth. Alternatively, the third actuator can cause the platform to move alternately to the left and to the right. The movement of the platform within a horizontal plane leads to a considerable improvement of the balance and coordination training.

In another development, the device according to the invention is configured to set the platform simultaneously in the vibration movement and the rocking movement. Alternatively or in addition, the device can be configured to set the platform simultaneously in the vibration movement and the linear movement. The combination of the vibration movement and of the rocking movement and the combination of the vibration movement and of the linear movement results in particularly effective training, since the combination of two types of movement brings about muscle reflexes that cannot be brought about during training with just one type of movement. The training outcome is thus further enhanced. In particular, the platform can also be set only in the vibration movement, the rocking movement or the linear movement.

In another advantageous embodiment of the device according to the invention, the first actuator, the second actuator and/or the third actuator each comprise one or more electrically drivable motors. Preferably, the first actuator, the second actuator and/or the third actuator are connectable to a power supply which provides electrical power to the actuators. The one or more electrically drivable motors of the first actuator, of the second actuator and/or of the third actuator can generate a rotary movement, for example, or as a linear drive can generate a translation movement. For example, the electrically drivable motors of the first actuator, of the second actuator and/or of the third actuator have a rated power of 200 watt or 500 watt.

The first actuator preferably has one or more gears which convert a rotation movement of a shaft into the vibration movement of the platform. Alternatively, the first actuator comprises a linear drive which generates corresponding vibrations directly. The platform is preferably deflected in the vertical direction by the vibration movement. For example, the vibration movement has a frequency of 50 Hz or 60 Hz.

The second actuator preferably has one or more gears which convert a rotation movement of a shaft into the rocking movement of the platform. In particular, the rotation movement of the drive shaft of an electrically drivable motor or of an intermediate shaft of the second actuator, connected to the drive shaft of the electrically drivable motor, is converted by a gear into an eccentric movement of a drive member, before the eccentric movement of the drive member is converted by a corresponding joint into a linear movement, which is forwarded to the platform. The direction of movement of the linear movement is preferably orthogonal to the platform, and the drive member is connected to the platform while being spaced apart from a horizontal rotation axis of the platform. Since the direction of movement of the linear movement is orthogonal to the platform and the drive member is connected to the platform while being spaced apart from the horizontal rotation axis of the platform, the linear movement is converted into a rocking movement of the platform.

The third actuator preferably has one or more gears which convert a rotation movement of a shaft into the linear movement of the platform. In particular, the rotation movement of the drive shaft of an electrically drivable motor or of an intermediate shaft of the third actuator, connected to the drive shaft of the electrically drivable motor, is converted by a gear into an eccentric movement of a drive member, before the eccentric movement of the drive member is converted by a corresponding joint into a linear movement, which is forwarded to the platform. The direction of movement of the linear movement is preferably parallel to the platform. Since the direction of movement of the generated linear movement is parallel to the platform, the generated linear movement is forwarded directly to the platform.

The first actuator, the second actuator and/or the third actuator can each have one or more belt drives. By means of belt drives, it is easy to obtain a transmission ratio which at the same time has shock absorption and overload prevention.

Moreover, the device according to the invention is advantageously developed such that the platform is rotated to and fro about a substantially horizontal rotation axis by the rocking movement. In particular, the rotation axis extends substantially centrally from the platform. Depending on the orientation of the device user, different impulses can thus be brought about, such that the rocking movement permits targeted and effective training of certain groups of muscles.

In a preferred embodiment, the device according to the invention has a control unit, which is configured to control the first actuator, the second actuator and the third actuator independently of one another. For this purpose, the control unit is connected wirelessly or by wire for signal transmission to the first actuator, the second actuator and the third actuator, preferably to the electrically drivable motors of said actuators. By means of the control unit, it is thus possible to adjust the desired types of movement of the platform and thereby adapt the device individually to the device user. Different types of movement can thereby be combined with one another or else individual types of movement can be set in separately.

In another development of the device according to the invention, the control unit is configured to change the intensity, the speed and/or the extent of the vibration movement, of the rocking movement and/or of the linear movement of the platform. The extent of the vibration movement comprises the oscillation amplitude of the platform in the vibration movement. The oscillation amplitude of the platform in the vibration movement is preferably between 0 and 2 millimeters. The extent of the rocking movement comprises the rotation angle of the platform in the rocking movement. The rotation angle of the platform in the rocking movement is preferably between 0 and 10 degrees, wherein the linear lateral deflection of the platform in the rocking movement is preferably between 0 and 13 millimeters. The extent of the linear movement comprises the length of the movement path of the platform in the linear movement. The length of the movement path of the platform in the linear movement is preferably between 0 and 14 millimeters. The speed of the vibration movement, of the rocking movement and/or of the linear movement is adjustable preferably in a stepless or stepped manner. For example, the speed of the vibration movement, of the rocking movement and/or of the linear movement can be adjusted in 60 steps.

In a further embodiment of the device according to the invention, the control unit can be operated wirelessly and/or via wire by means of an electronic appliance external to the device. The external electronic appliance is, for example, a personal computer or a mobile terminal such as a smartphone or a tablet. The control unit can preferably be operated by means of a corresponding program on the personal computer or a corresponding application on the mobile terminal. This therefore allows the device to be adapted conveniently and quickly to the individual requirements of the device user.

In a preferred embodiment of the device, the platform has a tread surface, which is configured for a device user to step on. The tread surface can also be configured such that the device user is able to lie, kneel or sit on the tread surface. With different postures, different groups of muscles can be trained using the device. Thus, the device can be used in a much more versatile way if the device user is able to adopt different postures on the device.

In another advantageous embodiment of the device according to the invention, the platform is mounted on a rubber or spring suspension. By means of a rubber or spring suspension, the platform can be deflected slightly by a corresponding load applied by the device user. Since the platform thus yields at a high load and/or a high speed of the load applied by the device user, the risk of injury during use of the device is considerably reduced, since load peaks are avoided or at least attenuated by the rubber or spring suspension.

In one embodiment, the device has a base plate on which the first actuator, the second actuator and/or the third actuator are arranged and preferably secured. The base plate and the platform are each made completely or partially of plastic or metal, for example. Since the first actuator, the second actuator and/or the third actuator are arranged and secured on the base plate, a high level of stability of the device is achieved. This permits a change of position or inclination of the device without causing damage or loss of function. The device is therefore movable and can be used at different positions or locations.

The device according to the invention preferably has one or more transport rollers by means of which the entire device is transportable. It is therefore not necessary to completely lift the entire device when changing position. The position of the device can therefore also be changed by just one person, as a result of which the convenience of use is considerably enhanced.

In another embodiment, the device according to the invention has a grip, by means of which the entire device can be lifted at least at one side. The grip is preferably arranged at a first side of the device, and the one or more transport rollers are arranged on a second, opposite side. The grip thus allows the device to be lifted comfortably at one side, and this lifting causes the one or more transport rollers to be brought into contact with the floor surface, such that the device can be moved.

It is moreover preferable that the device according to the invention has several support feet, wherein the height of one, several or all of the support feet is adjustable. The adjustability of the height of one, several or all of the support feet can serve, on the one hand, to compensate for uneven floor surfaces or, on the other hand, to adjust an inclination of the device. Since the inclination of the device is adjustable by means of the support feet, the device user is able to perform further exercises with the device.

BRIEF DESCRIPTION OF THE DRAWINGS

Preferred embodiments of the invention are explained and described in more detail below with reference to the attached drawings, in which.

DETAILED DESCRIPTION

Figure 1:
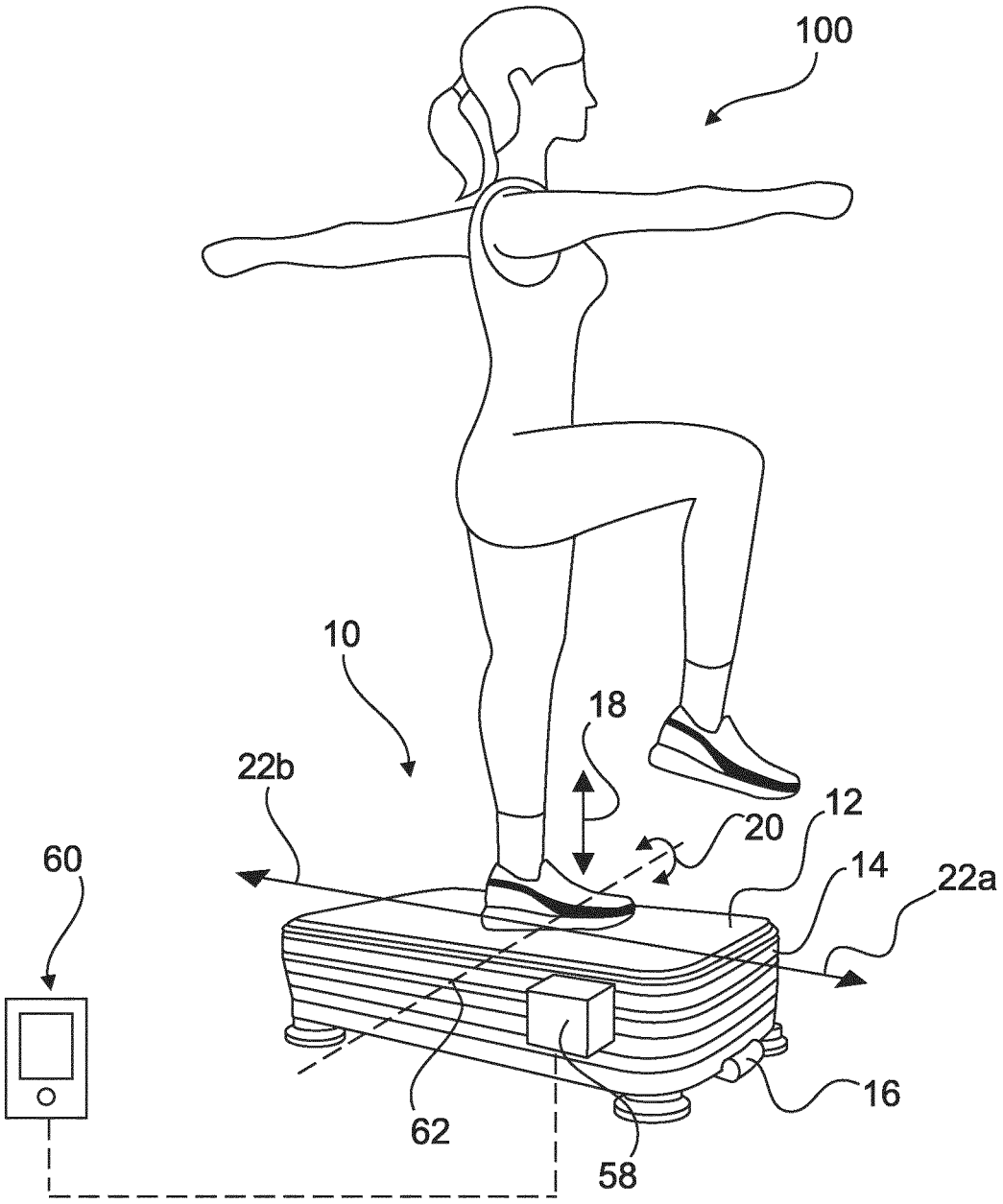
FIG. 1 shows a schematic view of an illustrative embodiment of the device according to the invention for vibration training.

According to FIG. 1, the device 10 for vibration training comprises a platform 12, a housing 14, a first actuator (concealed), a second actuator (concealed), a third actuator (concealed), and a control unit 58.

The platform 12 has a tread surface on which a device user 100 stands on one leg and performs an exercise. A grip 16, by means of which the entire device 10 can be lifted, is secured on the housing 14 of the device 10.

The first actuator is configured to set the platform 12 in a vibration movement 18. The second actuator is configured to rotate the platform 12 to and fro in a rocking movement 20 about a horizontal rotation axis 62, wherein the rotation axis 62 extends centrally from the platform 12. The third actuator is configured to move the platform 12 to and fro in a linear movement 22*a*, 22*b* within a horizontal plane.

The control unit 58 is connected for signal transmission to the first actuator, the second actuator and the third actuator and is configured to control and modify the intensity, the speed and the extent of the vibration movement 18, the rocking movement 20 and the linear movement 22*a*, 22*b* of the platform 12 independently of one another. By way of the control unit 58, it is thus possible to adjust the oscillation amplitude of the platform 12 during execution of the vibration movement 18, the rotation angle of the platform 12 during execution of the rocking movement 20, and the length of the movement path of the platform 12 during execution of the linear movement 22*a*, 22*b*.

The control unit 58 is wirelessly connected for signal transmission to an external electronic appliance 60 configured as a tablet. The control unit 58 can be operated by a corresponding application on the electronic appliance 60 external to the device.

Figure 2:
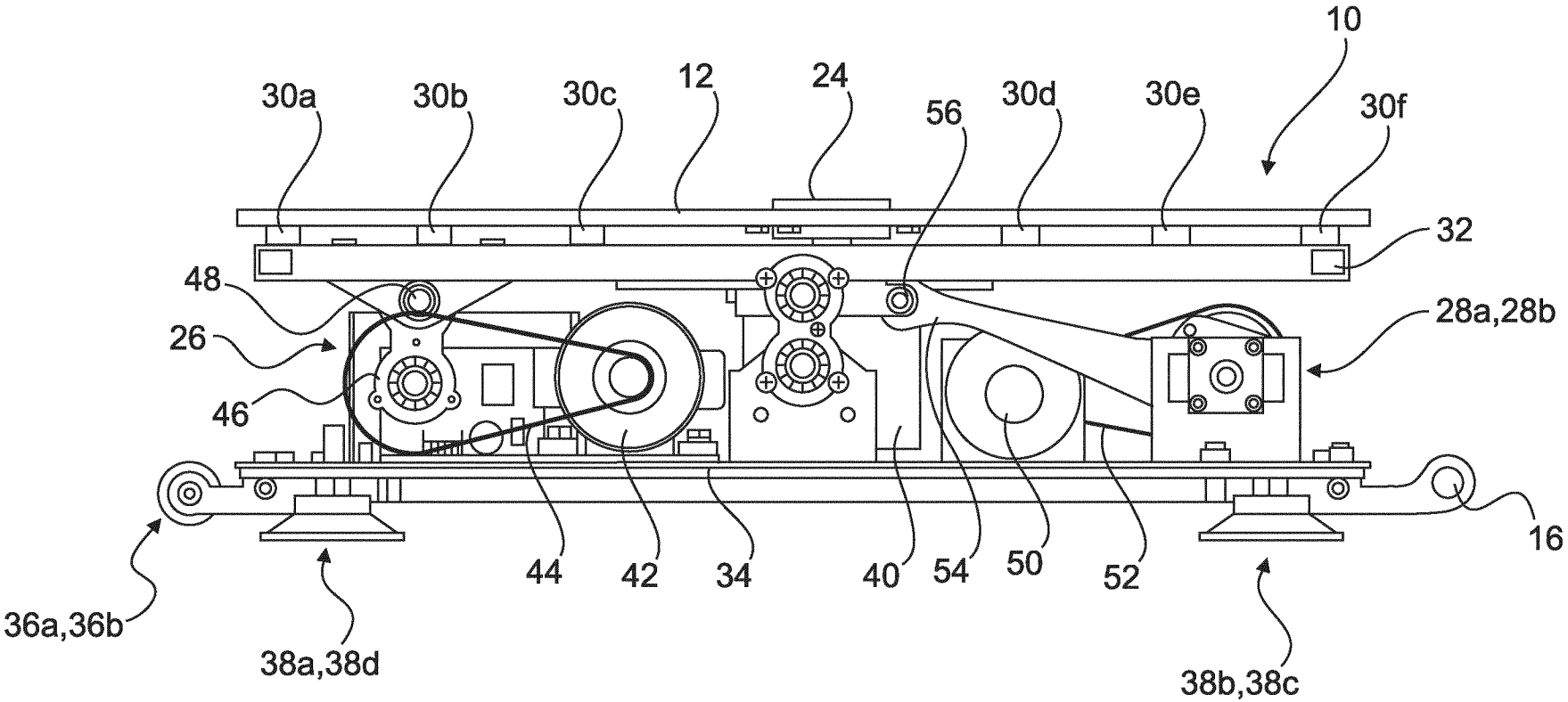
FIG. 2 shows a schematic view of a further illustrative embodiment of the device according to the invention for vibration training.
Figure 3:
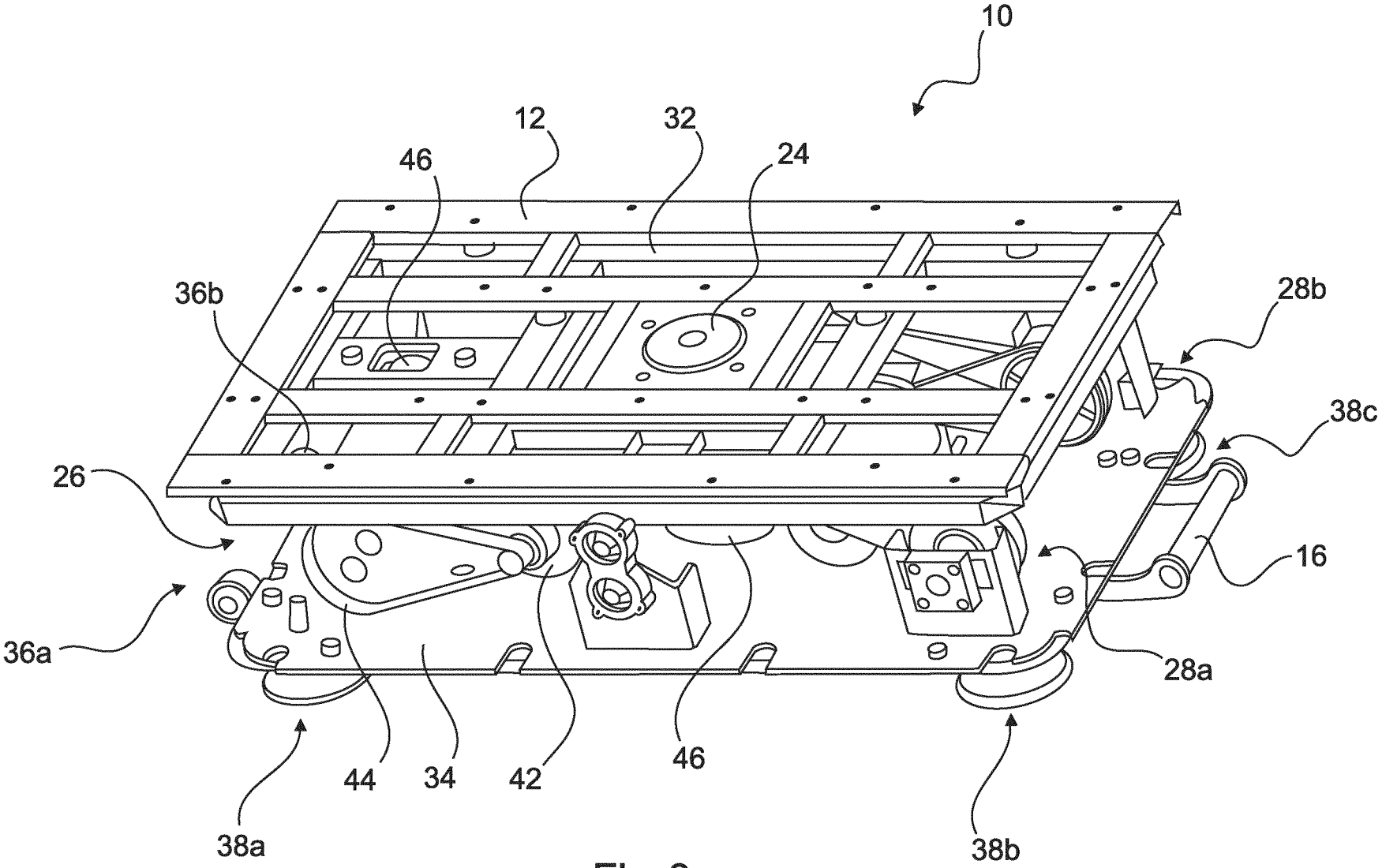
FIG. 3 shows the device for vibration training in FIG. 2 from a further perspective.

According to FIG. 2 and FIG. 3, the device 10 comprises a platform 12, an intermediate frame 32, a base plate 34, a housing (not shown), a first actuator 24, a second actuator 26, a third actuator 28*a*, 28*b*, and a control unit (not shown).

Arranged between the platform 12 and the intermediate frame 32, there are several rubber elements 30*a*-30*f* by which the platform 12 is mounted on a rubber suspension. A grip 16, by means of which the entire device 10 can be lifted, is secured on the base plate 34 of the device 10. Moreover, several transport rollers 36*a*, 36*b* are secured on the base plate 34 of the device 10, by means of which the entire device 10 is transportable. Moreover, the first actuator 24, the second actuator 26 and the third actuator 28*a*, 28*b* are arranged and secured on the base plate 34.

The first actuator 24 is configured to set the platform 12 in a vibration movement. The first actuator 24 moreover comprises an electrically drivable motor 40. The electrically drivable motor 40 is configured as a linear drive and alternately transmits up and down movements to the platform 12.

The second actuator is configured to rotate the platform 12 to and fro in a rocking movement 20 about a horizontal rotation axis, wherein the rotation axis extends centrally from the platform 12. The second actuator 26 comprises an electrically drivable motor 42, of which the drive shaft drives an intermediate shaft via a belt drive 44. The rotation movement of the intermediate shaft connected to the drive shaft of the electrically drivable motor 42 is transformed by a gear into an eccentric movement of a drive member 46, before the eccentric movement of the drive member 46 is transformed by a corresponding joint 48 into a linear movement, which is forwarded to the platform 12 via the intermediate frame 32. The direction of movement of the linear movement is orthogonal to the platform 12, and the drive member 46 is connected to the platform 12 while being spaced apart from the horizontal rotation axis of the platform 12.

The third actuator is configured to move the platform 12 to and fro in a linear movement 22*a*, 22*b* within a horizontal plane. The second actuator 28*a*, 28*b* comprises an electrically drivable motor 50, of which the drive shaft drives two intermediate shafts via two separate belt drives 52. The rotation movement of the intermediate shafts connected to the drive shaft of the electrically drivable motor 50 is transformed by respective gears into an eccentric movement of two drive members 54, before the eccentric movement of the drive members 54 is transformed by corresponding joints 56 into a linear movement. The direction of movement of the linear movement is parallel to the platform 12. Since the direction of movement of the linear movement is parallel to the platform 12, the linear movement is forwarded to the platform 12 without further transformation via the intermediate frame 32.

The device 10 moreover has four support feet 38*a*-38*d*, wherein the height of all of the support feet 38*a*-38*d* is adjustable.

REFERENCE SIGNS

10 device
12 platform
14 housing
16 grip
18 vibration movement
20 rocking movement
22*a*, 22*b* linear movement
24 first actuator
26 second actuator
28*a*, 28*b* third actuator

30*a*-30*f* rubber elements
32 intermediate frame
34 base plate 36*a*, 36*b* transport rollers
38*a*-38*d* support feet
40 motor
42 motor
44 belt drive
46 drive member
48 joint
50 motor
52 belt drive
54 drive member
56 joint
58 control unit
60 electronic appliance external to the device
62 rotation axis
100 device user

The invention claimed is:

1. A device for vibration training, the device comprising:

a platform including a tread surface configured and arranged to be stepped on by a device user;

a first actuator configured and arranged to set the platform in a vibration movement;

a second actuator configured and arranged to set the platform in an oscillating motion about a substantially horizontal axis that extends from a central portion of the platform, wherein the second actuator has one or more gears configured and arranged to convert a rotation movement of a shaft into the rocking movement of the platform; and a third actuator configured and arranged to set the platform in a linear movement, where the linear movement of the platform is within an at least substantially horizontal plane.

2. The device of claim 1, wherein the third actuator is further configured to move the platform to and fro.

3. The device of claim 1, wherein the device is configured and arranged to set the platform simultaneously in the vibration movement and the rocking movement or simultaneously in the vibration movement and the linear movement.

4. The device of claim 1, wherein at least one of the first actuator, the second actuator and the third actuator include one or more electrically drivable motors.

5. The device of claim 1, wherein the platform is configured to be rotated to and fro about a substantially horizontal rotation axis by the rocking movement.

6. The device of claim 1 further including a control unit configured to control the first actuator, the second actuator and the third actuator independently of one another.

7. The device of claim 6, wherein the control unit is configured to change the intensity, the speed and/or the extent of at least one of the vibration movement, the rocking movement and the linear movement of the platform.

8. The device of claim 6, wherein the control unit is configured to be operated wirelessly and/or via wire by an electronic appliance external to the device.

9. The device of claim 1, wherein the platform is mounted on a rubber or spring suspension.

10. The device of claim 1, further including a base plate on which at least one of the first actuator, the second actuator and the third actuator is arranged and secured.

11. The device of claim 1, further including one or more transport rollers configured to transport the device.

12. The device of claim 1, further including a grip configured to lift at least one side of the device.

13. The device of claim 1, further including a plurality of support feet, wherein the height of at least one of the support feet is adjustable.

* * * * *